US008162444B2

(12) United States Patent
Miura et al.

(10) Patent No.: US 8,162,444 B2
(45) Date of Patent: Apr. 24, 2012

(54) PRINTING HEAD AND MANUFACTURING METHOD OF PRINTING HEAD

(75) Inventors: Shinya Miura, Kawasaki (JP); Junichiro Iri, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 264 days.

(21) Appl. No.: 12/473,730

(22) Filed: May 28, 2009

(65) Prior Publication Data

US 2009/0309931 A1 Dec. 17, 2009

(30) Foreign Application Priority Data

Jun. 17, 2008 (JP) ..... 2008-158205

(51) Int. Cl.
*B41J 2/05* (2006.01)
*B41J 2/14* (2006.01)
*B41J 2/16* (2006.01)

(52) U.S. Cl. ..... 347/58; 347/20; 347/48; 347/50; 347/54; 347/56; 347/57; 347/61; 347/63; 438/21

(58) Field of Classification Search ..... 347/50, 347/58, 63; 438/21
See application file for complete search history.

(56) References Cited

U.S. PATENT DOCUMENTS 6,629,755 B2 * 10/2003 Saito et al. ..... 347/58
7,115,975 B2 10/2006 Mori
2006/0274127 A1 * 12/2006 Enomoto et al. ..... 347/68

FOREIGN PATENT DOCUMENTS

JP 2005-101546 4/2005

* cited by examiner

*Primary Examiner* — Ryan Lepisto
(74) *Attorney, Agent, or Firm* — Fitzpatrick, Cella, Harper & Scinto

(57) ABSTRACT

There is provided a printing head which improves durability and increases reliability by reducing stress occurring in a bonding part between an electrode pad and an inner lead at cooling. The electrode pad and the inner lead are electrically connected in such a manner that in the bonding portions between the electrode pad and a stud bump, only a part of contacting portions between the electrode and the stud bump is bonded.

8 Claims, 5 Drawing Sheets

PRINTING HEAD AND MANUFACTURING METHOD OF PRINTING HEAD

BACKGROUND OF THE INVENTION

1. Field of the Invention

The present invention relates to a printing head and a manufacturing method of a printing head, and particularly, to a manufacturing method of a printing head for bonding an electrode of a printing element substrate to a lead and a printing head manufactured by this manufacturing method.

2. Description of the Related Art

In recent years, an ink jet printing device which ejects ink droplets from a printing head to carry out the printing has been rapidly widely used. Such an ink jet printing device has an advantage that the downsizing is easy, color printing is relatively easily carried out, and the like.

Japanese Patent Laid-Open No. 2005-101546 has proposed a method in which in a printing head used in such an ink jet printing device and in a manufacturing method of the printing head, an electrode pad as an electrode is connected electrically through a stud bump to a flexible film wiring substrate. Japanese Patent Laid-Open No. 2005-101546 discloses the method in which the stud bump is arranged and bonded on the electrode formed as a film on a printing element substrate and the stud bump is bonded and connected to the flexible film wiring substrate equipped with a lead by an ILB method.

Hereinafter, among methods of electrically connecting this electrode to the flexible film wiring substrate, an example of the conventional method will be explained. FIGS. 4A to 4C and FIGS. 5A to 5E show an example of a conventional manufacturing method of the ink jet printing head. FIG. 4A is a perspective view showing a structure of an electrical connection portion in the printing head. FIG. 4B is an enlarged side view showing a key part in the printing head. FIG. 4C is an enlarged plan view showing the key part of the printing head. FIGS. 5A to 5E are explanatory diagrams showing and explaining a flow of processes in order in regard to an example of the conventional manufacturing method of the printing head upon manufacturing the printing head shown in FIGS. 4A to 4C.

First, as shown in FIG. 5A, a stud bump 103 is formed on an electrode pad (electrode) formed as a film on a printing element substrate (hereinafter, referred to as bump forming process also). At this point, the stud bump 103 is formed in a state where the printing element substrate 101 is fixed by vacuum absorption and is heated. The stud bump 103 to be formed on the electrode pad 102 on the printing element substrate 101 is formed by forming a gold (Au) wire to be in a spherical shape with spark. In a state where the stud bump 103 is put on the electrode pad 102 arranged on the heated printing element substrate 101, the bonding between the stud bump 103 and the electrode pad 102 is carried out. The bonding therebetween is carried out by applying a supersonic wave to the stud bump 103 in a state where the stud bump 103 is put on the electrode pad 102 and the stud bump 103 is pressed against the electrode pad 102. At the time of applying the supersonic wave to the stud bump 103, the bonding is carried out using a ball bump bonding tool. In this example, the formation of the stud bump 103 is made by a single point bonding method. In general, in the single point bonding method, a method of applying both of heat and supersonic wave is adopted in a semiconductor industry.

Next, as shown in FIG. 5B, in the stud bump 103 formed between an inner lead (lead) 108 and the electrode pad 102 by the bump forming process, an upper surface of a part of the stud bump 103 in an opposing side to the bonding part of the stud bump 103 with the electrode pad 102 is smoothed (hereinafter, referred to as smoothing process). At this point, in the same way as the bump forming process, the printing element substrate 101 is fixed by the vacuum absorption and is then heated. The smoothing process is carried out by applying a supersonic wave to a cutting part of the gold wire produced at the time of forming the stud bump 103 in a state of pressing a bonding tool for smoothing against the stud bump 103. This smoothing is carried out by the single point bonding method.

Next, as shown in FIG. 5C, the printing element substrate to which the smoothing process has been executed is bonded and fixed to a support member and the flexible film wiring substrate 109 having the inner lead 108 is bonded and fixed to a support plate 107 fixed on a support member 106. At this point, the electrode pad 102 on the printing element substrate 101 and the inner lead 108 are respectively arranged in such a manner as to be accurately positioned and thereafter, bonded and fixed (hereinafter, referred to as mount process).

Next, as shown in FIG. 5D, the electrode pad 102 and the inner lead 108 positioned in the mount process are bonded through the stud bump 103 (hereinafter, referred to as ILB bonding process). At this point, the support member 106 after the mount process is fixed by vacuum adsorption and is then heated. In the ILB bonding process, the inner lead 108 is pushed in toward the electrode pad 102 in a state where the stud bump 103 is sandwiched between the inner lead 108 and the electrode pad 102. The electrode pad 102 and the inner lead 108 are bonded by applying the supersonic wave to the stud bump 103 using the bonding tool for ILB. At this time, the ILB bonding process is carried out by the single point bonding method.

The single point bonding is one of the ILB (Inner Lead Bonding) methods and is a method of individually, selectively and in sequence bonding objects one by one. The other of the ILB methods is a gang bonding method of bonding plural bonding objects together at a time. In either case, the bonding objects are bonded in a highly heated state. When two methods thereof are compared in a case where the bonding objects are bonded on the same condition, the bonding by the single point bonding method is possible at a lower temperature than by the gang bonding method. Even in a case of the single point bonding method, however, the minimum temperature required for bonding is a relatively high temperature and it is required to heat the bonding object to approximately 180° C. By this heating, the printing element substrate 101 and the flexible film wiring substrate 109 are bonded in a thermal expansion state.

Next, as shown in FIG. 5E, after the printing element substrate 101 and the flexible film wiring substrate 109 are bonded by the ILB process, these elements are cooled by natural convection of the surrounding environment or the like (hereinafter, referred to as a cooling process). At this point, a thermal expansion coefficient of the printing element substrate 101 formed of silicon (Si) is much smaller than that of the inner lead 108 formed mainly of copper (Cu) or the flexible film wiring substrate 109 formed mainly of resin material. Therefore, when the cooling process is completed, a difference in contracting amount between the printing element substrate 101 and the inner lead 108 or between the printing element substrate 101 and the flexible film wiring substrate 109 occurs. In consequence, stress occurs between the electrode pad 102 and the inner lead 108 after the cooling process. This stress occurs between the stud bump 103 and the inner lead 108, but more stress occurs between the electrode pad 102 and the stud bump 103. When the stress occurring and remaining inside these members at this point is excessively large, this stress possibly causes the bonding part between the electrode pad 102 and the stud bump 103 to be damaged.

For overcoming such a problem, Japanese Patent Laid-Open No. 2005-101546 discloses means for forming a through bore or a recessed groove in an inner lead to reduce rigidity of the inner lead, thereby alleviating stress occurring between an electrode pad and the inner lead.

In the field of the ink jet printing head, a demand for the further shrinking of the printing element substrate is increasing. This demand is true of an electrical connection part of the ink jet printing head and therefore, technologies for downsizing of a pad and downsizing of a stud bump corresponding to the downsizing of the pad become an important factor for meeting this demand.

However, when the inner lead and the electrode pad are bonded by the ILB bonding in a state where the stud bump is downsized, a ratio of the stud bump formed of a relatively flexible and easily deformable material is lowered to seemingly increase rigidity of the inner lead bonded by the ILB bonding process. In consequence, stress caused by a difference in thermal expansion coefficient between the printing element substrate and the flexible film wiring substrate occurs between the electrode pad and the inner lead in the cooling process, and this stress possibly causes damages at the bonding part between the electrode pad and the stud bump.

As a result of the downsizing of the stud bump, it is required to increase a bonding area between the stud bump and the inner lead by more strongly pushing the inner lead into the stud bump at ILB bonding. Therefore, an external force applied to the electrode pad results in increasing.

SUMMARY OF THE INVENTION

Thus, in view of the above-described circumstances, an object of the present invention is to provide a printing head in which stress occurring in a bonding part between an electrode pad and an inner lead at cooling is reduced, thereby improving durability and increasing reliability.

The first aspect of the present invention is a printing head comprising: a printing element applying energy to a liquid for ejecting the liquid reserved in a liquid chamber; an electrode formed at an end of a wire extending from the printing element for transmitting electrical energy to the printing element; a lead being a wire extending toward the electrode for transmitting electrical energy for driving the printing element through the electrode; and a stud bump contacting with and bonded to the electrode and the lead for electrical connection between the electrode and the lead, wherein: in bonding portions between the electrode and the stud bump, only a part of contacting portions between the electrode and the stud bump is bonded, thus creating the electrical connection between the electrode and the lead.

The second aspect of the present invention is a manufacturing method of a printing head comprising: a printing element applying energy to a liquid for ejecting the liquid reserved in a liquid chamber; an electrode formed at an end of a wire extending from the printing element for transmitting electrical energy to the printing element; a lead formed at an end of a wire extending toward the electrode for transmitting electrical energy for driving the printing element through the electrode; and a stud bump contacting with and bonded to the electrode and the lead for electrical connection between the electrode and the lead, the manufacturing method of the printing head comprising: a heating step of in advance heating a stud bump forming member formed of a material which is molten by heating and is solidified by cooling, the electrode and the lead; a stud bump forming member arranging step of arranging the stud bump forming member at the electrode; a stud bump forming member smoothing step of smoothing a contacting part of the stud bump forming member arranged in the electrode with the lead; and an electrode bonding step of pressing the stud bump forming member against the electrode by a load of the stud bump forming member itself and bonding the stud bump forming member and the electrode by heat at the heating step.

According to the present invention, the stress remaining in the bonding part between the electrode and the lead in the printing head can be reduced. Therefore, it is possible to improve durability of the printing head and also reliability of the printing head.

Further features of the present invention will become apparent from the following description of exemplary embodiments (with reference to the attached drawings).

DESCRIPTION OF THE EMBODIMENTS

Hereinafter, an embodiment of the present invention will be explained with reference to the accompanying drawings.

Figure 1:
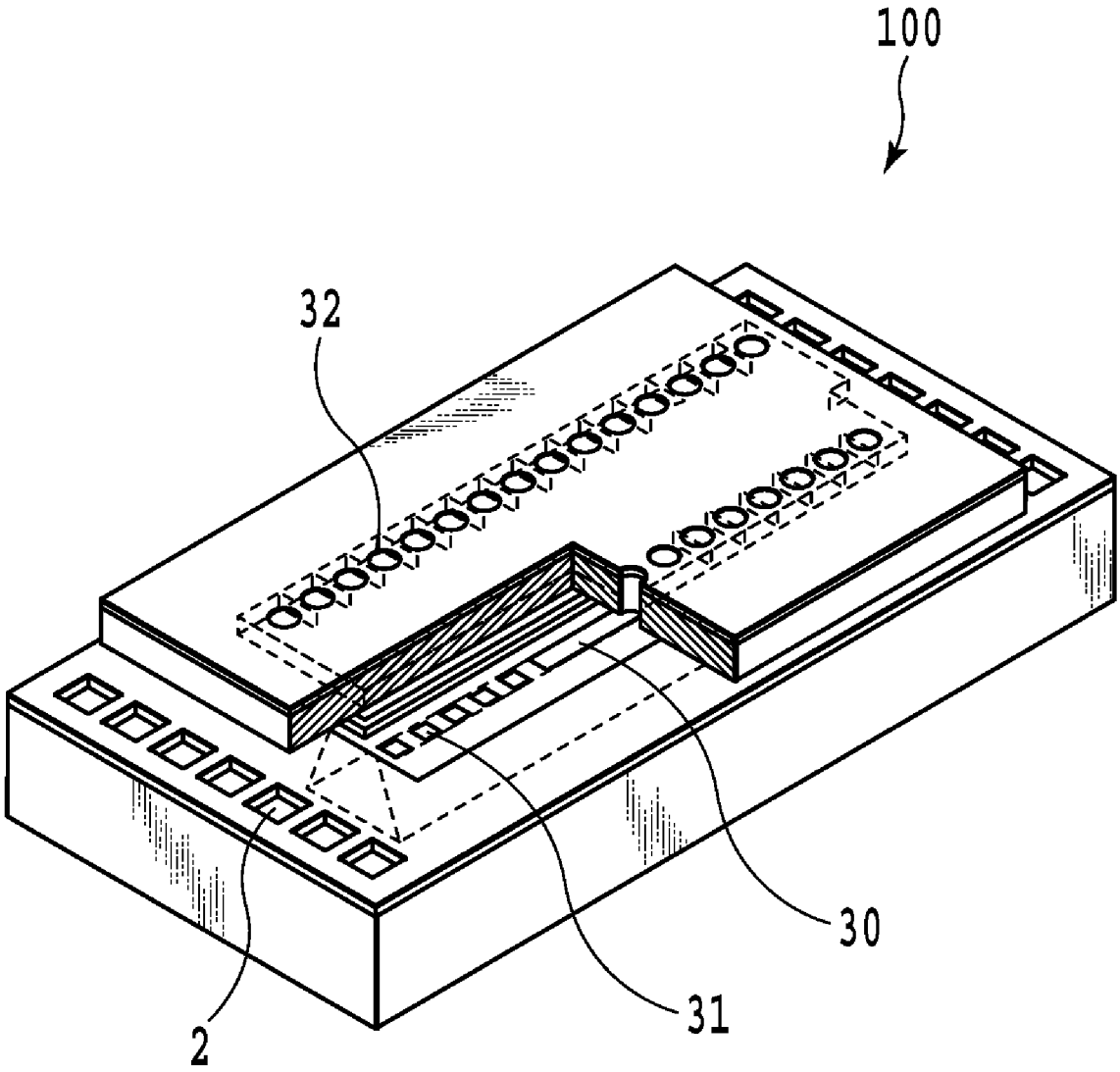
FIG. 1 is a perspective view showing a printing head according to an embodiment of the present invention.
Figure 2A:
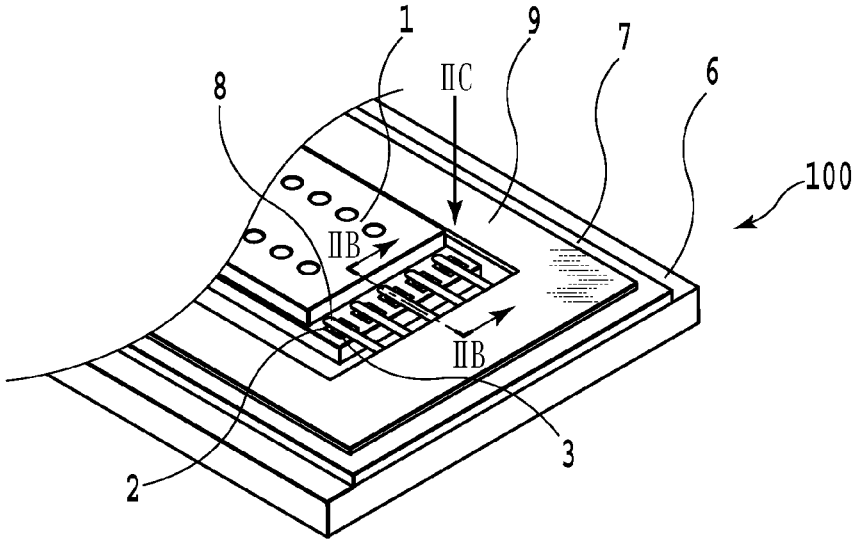
FIG. 2A is a perspective view showing bonding portions between an electrode pad and an inner lead in the printing head according to the embodiment of the present invention.
Figure 2B:
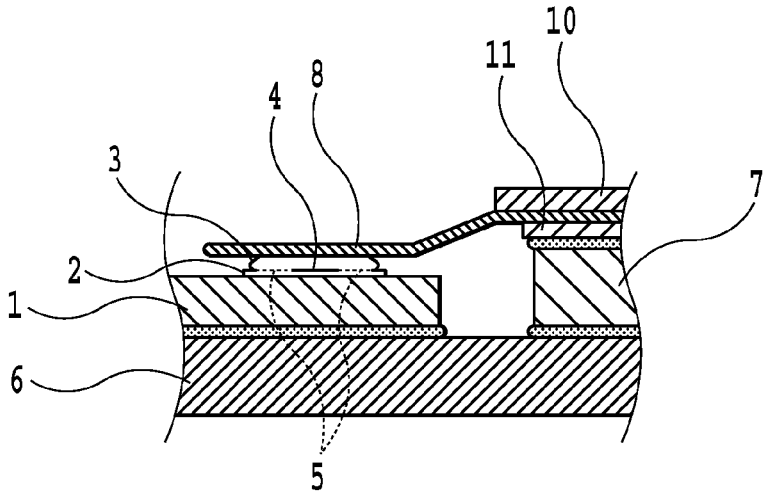
FIG. 2B is a cross-sectional view taken along line IIB-IIB in FIG. 2A
Figure 2C:
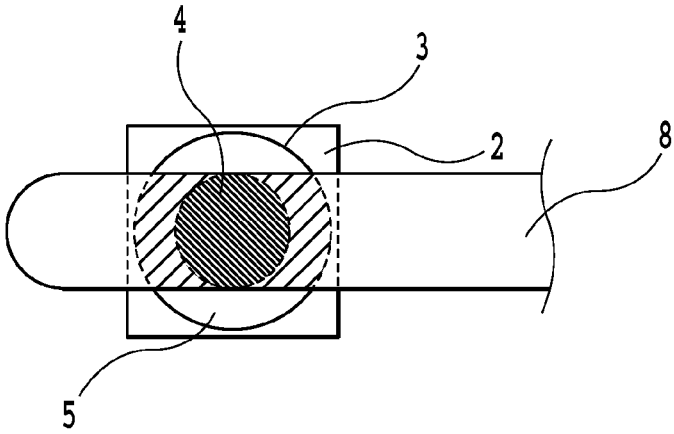
FIG. 2C is a plan view of FIG. 2A in an arrow IIC direction.

FIG. 1 is a perspective view showing a printing element substrate 1 used in a printing head according to an embodiment of the present invention. The printing element substrate 1 is, as shown in FIGS. 2A to 2C, connected to a flexible film wiring substrate 9 to form a printing head 100. Liquid chambers 30 are formed in the printing element substrate 1 in the printing head 100 of the present embodiment. Ink as a liquid ejected from the printing head is reserved inside the liquid chamber 30. Further, printing elements 31 applying energy to ink for ejecting the ink reserved in the liquid chamber 30 are arranged inside the liquid chamber 30. Ejection ports 32 for ejecting ink are formed in the printing element substrate 1 by a photolithography technology in such a manner as to correspond to the printing elements 31 arranged inside the liquid chamber 30. The ink to which thermal energy is given by driving the printing element 31 causes film boiling inside the liquid chamber 30, thereby ejecting the ink from the ejection port 32 toward a printing medium.

This printing element substrate 1 is bonded and fixed to a support member 6 as shown in FIGS. 2A to 2C. The printing element substrate 1 is connected electrically to the flexible film wiring substrate 9 fixed to the support member 6 to form the printing head 100.

FIGS. 2A to 2C show electrical connection portions between an electrode pad 2 as an electrode of the printing element substrate 1 and an inner lead 8 as a lead of the flexible film wiring substrate 9 in the printing head according the embodiment of the present invention. The flexible film wiring substrate 9 is bonded and fixed to a support plate 7, which is bonded and fixed in advance to the support member 6.

FIG. 2A is a perspective view showing a periphery of the bonding portions between the printing element substrate and the flexible film wiring substrate in the printing head according to the present embodiment, FIG. 2B is a cross-sectional view taken along line IIB-IIB in FIG. 2A and FIG. 2C is a plan view of the printing head in FIG. 2A in an arrow IIC direction. In the present embodiment, a direction of ejecting ink as a liquid is defined as a liquid ejection direction.

In the present embodiment, the printing element substrate 1 is formed of silicon (Si). A wire (not shown) formed of aluminum (Al) is formed on a surface of the printing element substrate 1 by a film formation method. The electrode pad 2 is formed at an end of this wire. The electrode pad 2 is formed at a position near an outer edge of the printing element substrate 1. The electrode pad 2 is formed in a square having a dimension of 160 μm×160 μm. The wire extends from the printing element 31 toward an outside of the printing element substrate 1 for transmitting electrical energy to the printing element 31. The wire is formed to connect between the electrode pad 2 and the printing element 31, thereby enabling transmission of electrical energy therebetween.

The flexible film wiring substrate 9 is arranged outside of the printing element substrate 1 in such a manner as to surround the printing element substrate 1 and is supported by the support plate 7. The support plate 7 and the printing element substrate 1 are supported by the support member 6. In the present embodiment, the support member 6 is formed of alumina ($Al_2O_3$). The printing element substrate 1 is arranged to be positioned inside of the flexible film wiring substrate 9. As shown in FIG. 2A, the printing element substrate 1 and the flexible film wiring substrate 9 are arranged at a position where the printing element substrate 1 and the flexible film wiring substrate 9 do not overlap with each other in an ink ejection direction.

The inner lead 8 is formed in the flexible film wiring substrate 9 for transmitting electrical energy for driving the printing element through the electrode pad 2. The inner lead 8 is formed at an end of the wire in a side of the flexible film wiring substrate 9. The inner lead 8 is formed to extend from the flexible film wiring substrate 9 toward the electrode pad 2. The flexible film wiring substrate 9 is formed to include a planar base film 10 formed of insulating resin, the conductive inner lead 8 formed of copper foil and a resist layer 11. Plating treatment by gold (Au) is carried out on a surface of the inner lead 8. The stud bump 3 is arranged between the electrode pad 2 and the inner lead 8 in such a manner as to contact with them for electrically connecting the electrode pad 2 and the inner lead 8.

The electrode pad 2 and the inner lead 8 are bonded through the stud bump 3 by the single point bonding method. In consequence, the printing element substrate 1 and the flexible film wiring substrate 9 are bonded electrically. In the present embodiment, the stud bump is formed of gold (Au) and has a diameter of 115 μm.

At this point, in the bonding portions between the electrode pad 2 and the stud bump 3, only a part of the contacting portions between the electrode pad 2 and the stud bump 3 is bonded. The electrode pad 2 and the stud bump 3 are bonded in such a manner that portions which are contacted, but are not bonded, exist. Here, an area of the portions in which the electrode pad 2 and the stud bump 3 are bonded between the electrode pad 2 and the stud bump 3 is set as S1 in an ink ejection direction. An area of the portions in which the electrode pad 2 and the stud bump 3 are contacted, but are not bonded between the electrode pad 2 and the stud bump 3, is set as S2 in the ink ejection direction. At this point, the printing head 100 is formed so that a ratio of S1 to S2 is equal to or less than 1.0. In the present embodiment, the stud bump is sized to have a diameter of 115 μm, and the electrode pad 2 and the stud bump 3 are bonded so that a ratio between the area (S1) of the bonded region and the area (S2) of the non-bonded region is a relation of S1/S2=0.74, thus forming the printing head 100. In addition, the stud bump is formed so that when a diameter of the stud bump is set as R and a height thereof is set as T, a ratio of R to T is equal to or more than 7.

In the present embodiment, the printing head 100 is formed so that a diameter of the stud bump 3 is equal to or less than 150 μm and a height thereof is equal to or less than 15 μm. In the present embodiment, particularly in a state where the stud bump 3 is bonded to the electrode pad 2 and the inner lead 8, the stud bump 3 is formed in a columnar shape having a diameter of 115 μm and a height of 15 μm.

In the present embodiment, the printing head 100 is formed so that, in the connection portions between the electrode pad 2 and the stud bump 3, portions which are contacted, but are not bonded, exist. In this way, the printing head 100 is formed so that only a part of the contacting portions of the electrode pad 2 with the stud bump 3 is bonded, between the electrode pad 2 and the stud bump 3. In the process of manufacturing the printing head 100, at the time of bonding the stud bump 3 between the electrode pad 2 and the inner lead 8, the electrode pad 2, the stud bump 3 and the inner lead 8 are heated once, and thereafter, are cooled. At this point, a difference between an expansion amount by heating and a contraction amount by cooling among them generates stress between the electrode pad 2 and the stud bump 3. However, the printing head 100 in the present embodiment can deform the portions which are not bonded. In this way, it is possible to release the stress generated between the electrode pad 2 and the stud bump 3 to the non-contacted portions. Therefore, the stress remaining between the electrode pad 2 and the stud bump 3 can be reduced. In consequence, occurrence of damages in the connection portions between the electrode pad 2 and the stud bump 3 can be restricted. As a result, durability of the printing head can be improved and reliability of the printing head can be enhanced.

Further, by forming the bonded stud bump in a thin shape, even if the stress is generated due to the difference between an expansion amount and a contraction amount of the bonded portions by the heating and the cooling subsequent thereto, this stress can be transmitted between the stud bump and the inner lead. Therefore, the stress generated between the electrode pad 2 and the stud bump 3 can be supported also by a bonding surface between the stud bump 3 and the inner lead 8. As a result, it is possible to reduce stress in the portion in which large stress occurs, and it is possible to improve durability of the printing head 100.

Next, a connection method of the electrical connection portions between the electrode pad 2 of the printing element substrate 1 and the inner lead 8 of the flexible film wiring substrate 9 in the printing head 100 will be explained.

First, the wire is formed in the printing element substrate 1 by a photolithography or the like before the electrode pad 2 and the stud bump 3 are bonded. Likewise in the flexible film wiring substrate 9, the wire is formed by the photolithography or the like. At this time, the wiring electrode and the inner lead formed in the flexible film wiring substrate 9 or the electrode pad 2 formed in the printing element substrate 1 is also formed.

Before the electrode pad 2 and the stud bump 3 are bonded, the heating process of heating a stud bump forming member which will become the stud bump 3 later, the electrode pad and the inner lead is executed. Here, in a state where the stud bump is heated and, as a result, has fluidity, the stud bump in this state is defined as a stud bump forming member for explanation. In this way, the stud bump is formed of a material which is melted by heating and solidified by cooling. In particular, in the present embodiment, the stud bump is designed to be formed of gold (Au).

Then, an arrangement process of the stud bump forming member in which the stud bump forming member is arranged in the electrode pad 2 is executed. At this point, the stud bump forming member is formed by arranging a spherical gold ball formed of gold on the electrode pad. At this point, it is required that an appropriate size of the initial gold ball is calculated from a target shape in the ILB bonding process and the gold ball in an appropriate shape is in advance formed. The gold ball is formed in a spherical shape by the sparking to the gold wire. In the present embodiment, the gold ball is formed so that a diameter of the stud bump 3 is 115 μm. Specially the gold ball is formed by setting a diameter of the initial gold ball as 55 μm. It is preferable that the stud bump 3 is formed in a bowl shape for more easily carrying out the work of the stud bump in the next smoothing process.

Next, it is executed that a smoothing process of the stud bump forming member for smoothing a contacting part of the stud bump forming member arranged on the electrode pad 2 with the inner lead. The smoothing process of the stud bump forming member is executed by pressing the stud bump forming member toward the electrode pad 2 using the bonding tool for smoothing. At this point, the smoothing process of the stud bump forming member is executed without applying the supersonic wave. In the smoothing process of the stud bump forming member, the stud bump 3 is configured in a target shape having a diameter equal to or less than 150 μm and a height equal to or less than 15 μm. In the present embodiment, particularly the stud bump 3 is configured to have a diameter of 115 μm and a height of 15 μm.

Next, it will be explained that an electrode pad bonding process as an electrode bonding process in which the stud bump forming member is pressed against the electrode pad 2 by a load of the stud bump forming member itself and the stud bump forming member and the electrode pad 2 are bonded by heat in the heating process. Here, the stud bump forming member is bonded to the electrode pad 2 by a single point bonding method. When the stud bump forming member is bonded to the electrode pad 2 by the single point bonding method, the stud bump is configured to have a diameter of approximately 75 μm.

Then, the bonding between the electrode pad 2 and the stud bump forming member is carried out, without an application of a supersonic wave, by a heating function in a state where the stud bump forming member is pressed against the electrode pad 2 by the load of the stud bump forming member. By thus carrying out the bonding between the electrode pad 2 and the stud bump forming member only with the function of the heating and the load, it is possible to increase only a diameter of the stud bump without increasing a bonding area at the time of forming the stud bump more than necessary. In consequence, it is possible to connect the electrode pad 2 with the stud bump 3 by a state where only a part of the contacting portions between the electrode pad 2 and the stud bump 3 is bonded. In the present embodiment, at this point a heating temperature to the electrode pad 2 and the stud bump forming member is set as 180 degrees and a smoothing load thereto is set as 200 gf. In this case, there is a limit to formation of the stud bump because of the initial gold ball size, but the stud bump can be formed in a target shape by changing conditions of heating and loading. By thus bonding the electrode pad 2 and the stud bump 3, the stud bump 3, which is formed in a columnar shape and is equipped with a non-bonding region 5 in the periphery outside of the bonding region 4 between the electrode pad 2 and the stud bump 3, can be formed. In the present embodiment, for bonding the stud bump 3 to the electrode pad 2, a tool for bump forming having an IC angle (Inner Chamfer Angle) of 120 degrees is used.

Next, the process in which the inner lead 8 is bonded to the stud bump forming member bonded to the electrode pad 2 will be explained. The stud bump 3 and the inner lead 8 are bonded by the single point bonding method. In this case, at a point where the stud bump forming member is smoothed, the stud bump forming member is sized to have a diameter of 115 μm and a height of 15 μm. The inner lead 8 is sized to have a width of 85 μm. Since the diameter of the stud bump forming member is thus larger than the width of the inner lead 8, it is not necessary to press and squeeze the inner lead 8 into the stud bump 3 at bonding for increasing the contacting area of the stud bump 3 with the inner lead 8. In consequence, it is possible to carry out the bonding between the stud bump 3 and the inner lead 8 in a load as low as possible not to cause deformation of the stud bump 3. In the present embodiment, the load of 80 gf is applied at this time for the bonding. Therefore, it is possible to restrict a mechanical external force to be applied to the bonding portions between the electrode pad and the inner lead at the bonding between the inner lead and the stud bump.

The stress occurring between the stud bump forming member and the inner lead at the subsequent cooling process reaches the bonding part between the stud bump forming member and the electrode pad. At this point, since the connection portions between the electrode pad 2 and the stud bump forming member include a part in which the stud bump forming member is not bonded to the electrode pad 2 and which is deformable, the stress can be released to that part. Here, it is preferable that, for efficiently transmitting the stress, the non-bonding region in which the stud bump forming member is not bonded to the electrode pad 2 is positioned right under the inner lead 8.

Then, the electrode pad 2, the stud bump forming member and the inner lead 8 are cooled, the stud bump forming member is solidified and will become the stud bump 3. In consequence, the electrode pad 2 and the inner lead 8 are electrically connected through the solidified stud bump 3.

Figure 3:
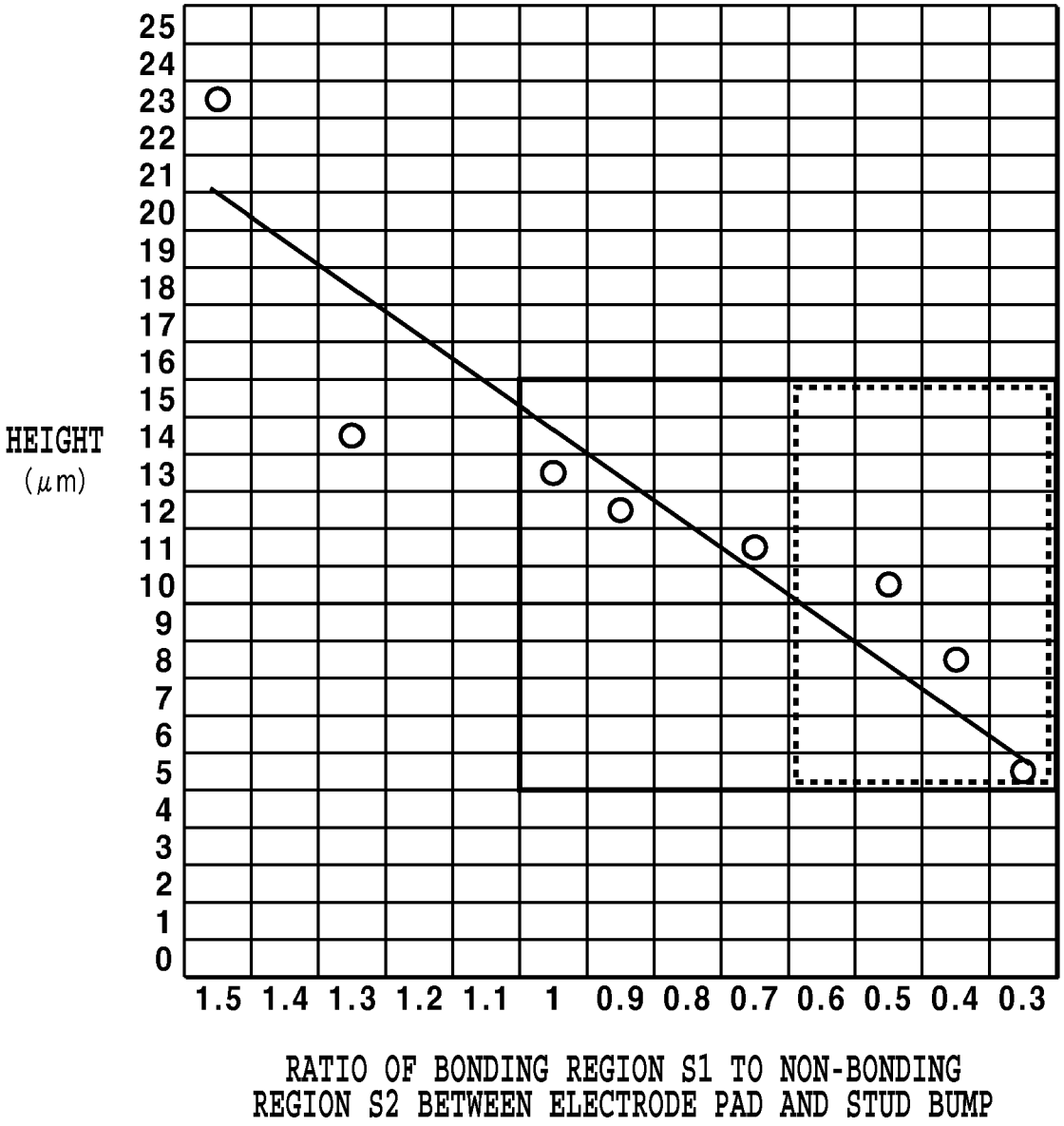
FIG. 3 is a graph in which a vertical axis shows a height of a stud bump and a lateral axis shows a ratio of a bonding region S1 to a non-bonding region S2 between the electrode pad and the stud bump.
Figure 4A:
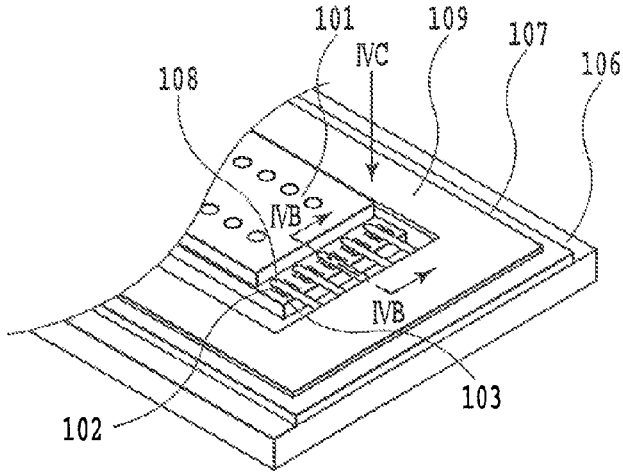
FIG.4A PRIOR ART
FIG. 4A is a perspective view showing bonding portions between an electrode pad and an inner lead in the conventional printing head.
Figure 4B:
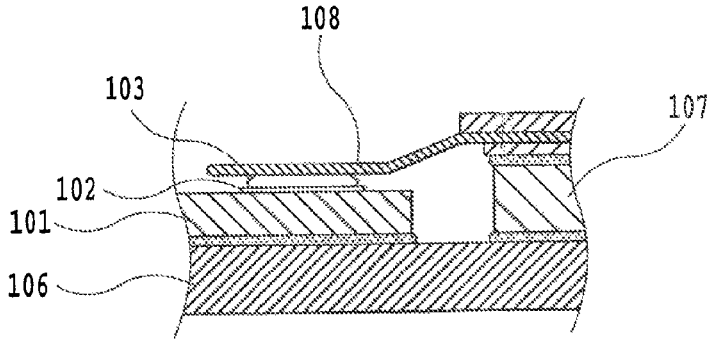
FIG.4B PRIOR ART
FIG. 4B is a cross-sectional view taken along line IVB-IVB in FIG. 4A
Figure 4C:
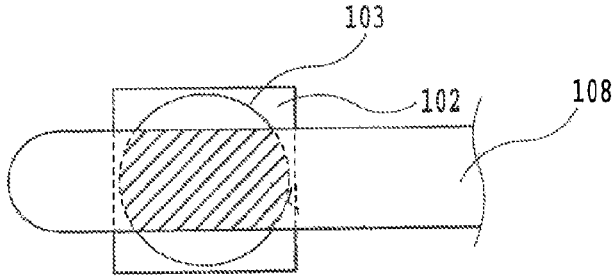
FIG.4C PRIOR ART
FIG. 4C is a plan view of FIG. 4A in an arrow IVC direction.
Figure 5A:
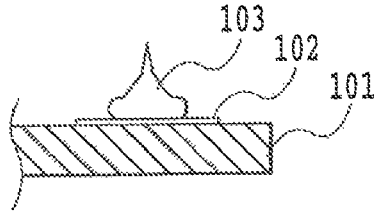
FIG.5A PRIOR ART
FIGS. 5A to 5E are explanatory diagrams explaining the process in a manufacturing method of the conventional printing head.
Figure 5B:
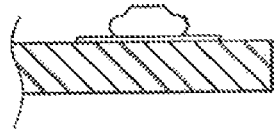
FIG.5B PRIOR ART
Figure 5C:
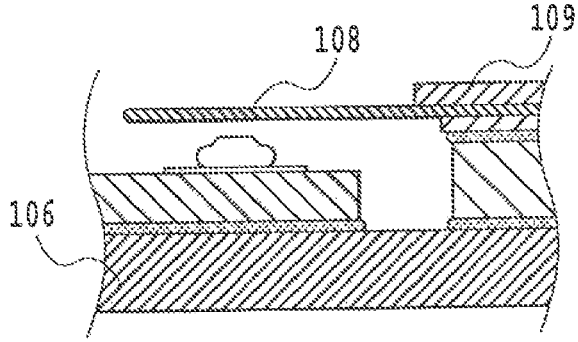
FIG.5C PRIOR ART
Figure 5D:
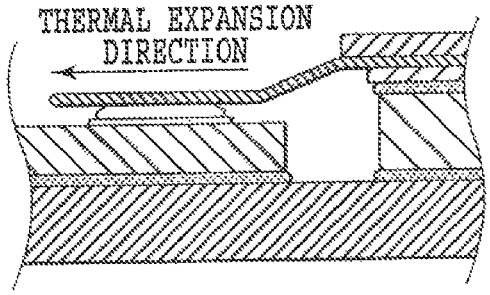
FIG.5D PRIOR ART
Figure 5E:
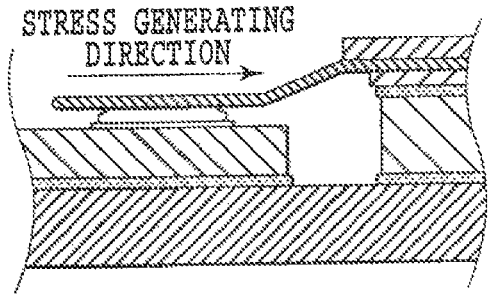
FIG.5E PRIOR ART

FIG. 3 is a graph showing a region obtained by the studies including the aforementioned present embodiment, in which it is possible to alleviate the stress as much as to prevent damage to the bonding part between the electrode pad and the stud bump. FIG. 3 is a graph in which a vertical axis shows a height of the stud bump and a lateral axis shows S1/S2 as a ratio between an area of a region (S1) in which the electrode pad 2 and the stud bump 3 are bonded and an area (S2) of a non-bonding region thereof.

In a region where the stud bump height is equal to or less than 15 μm and the S1/S2 is equal to or less than 1.0 in a graph in FIG. 3, the stress occurring in the bonding part between the electrode pad and the stud bump is alleviated, thus being kept a good bonding state. However, in a region surrounded by a broken line within a heavy-line frame in FIG. 3, it is found out that the stress in the bonding part is alleviated, but the neighboring stud bumps are contacted with each other at smoothing, causing electrical short. In regard to this problem, in order that the neighboring stud bumps are not contacted with each other, a ball diameter of the initial stud bump is adjusted to be small before the stud bump is formed, reducing a volume of the stud bump. As a result, occurrence of the electrical short can be controlled. In this way, the stud bump is smoothed after the stud bump is configured to be small. Therefore, it is possible to prevent the contact of the neighboring stud bumps and also it is possible to alleviate the stress causing the damage in the bonding part between the electrode pad and the stud bump.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-158205, filed Jun. 17, 2008, which is hereby incorporated by reference herein in its entirety.

What is claimed is:

1. A printing head comprising:

a printing element substrate comprising a printing element applying energy to a liquid for ejecting the liquid stored in a liquid chamber and an electrode electrically connected to a wire extending from the printing element for transmitting electrical energy to the printing element;

a stud bump contacting with and bonded to the electrode; and a wiring substrate including a wire for transmitting electrical energy for driving the printing element and a lead formed at an end of the wire and connected with the stud bump, wherein in bonding portions between the electrode and the stud bump, only a part of contacting portions between the electrode and the stud bump is bonded, and between the electrode and the stud bump, when an area of portions in which the electrode and the stud bump are bonded is set as S1 and an area of the contacting portions in which the electrode and the stud bump are contacted, but not bonded, is set as S2, a ratio of S1 to S2 is equal to or less than 1.0.

2. A printing head according to claim 1, wherein a diameter of the stud bump is equal to or less than 150 μm and a height thereof is equal to or less than 15 μm.

3. A printing head according to claim 1, wherein when a diameter of the stud bump is R, and a height thereof is T, a ratio of R to T is equal to or more than 7.

4. A manufacturing method of a printing head comprising a printing element applying energy to a liquid for ejecting the liquid stored in a liquid chamber, an electrode formed at an end of a wire extending from the printing element for transmitting electrical energy to the printing element, a lead formed at an end of a wire extending toward the electrode for transmitting electrical energy for driving the printing element through the electrode, and a stud bump contacting with and bonded to the electrode and the lead for electrical connection between the electrode and the lead, the manufacturing method of the printing head comprising:

a heating step of heating a stud bump forming member, the electrode and the lead, the stud bump forming member being formed of a material which is melted by heating and is solidified by cooling;

an arranging step of arranging the stud bump forming member at the electrode;

a smoothing step of smoothing a contacting part of the stud bump forming member arranged to contact the lead; and a bonding step of pressing the stud bump forming member against the electrode by a load composed of the stud bump forming member itself and bonding the stud bump forming member and the electrode by heat applied at the heating step.

5. A manufacturing method of the printing head according to claim 4, wherein the bonding step is executed in such a manner that in the bonding portions between the stud bump formed by solidifying the bond between the stud bump forming member and the electrode, only a part of contacting portions between the electrode and the stud bump forming member is bonded.

6. A manufacturing method of the printing head according to claim 5, wherein the bonding step is executed in such a manner that when an area of the bonding portions between the electrode and the stud bump is set as S1 and an area of the contacting portions in which the electrode and the stud bump are contacted, but not bonded, is set as S2, a ratio of S1 to S2 is equal to or less than 1.0.

7. A manufacturing method of the printing head according to claim 5, wherein the bonding step is executed in such a manner that a diameter of the stud bump is equal to or less than 150 μm and a height thereof is equal to or less than 15 μm.

8. A manufacturing method of the printing head according to claim 5, wherein the bonding step is executed in such a manner that when a diameter of the stud bump is R, and a height thereof is T, a ratio of R to T is equal to or more than 7.

* * * * *